United States Patent [19]

McIntosh et al.

[11] Patent Number: 4,942,544

[45] **Date of Patent: * Jul. 17, 1990**

[54] MEDICATION CLOCK

[75] Inventors: Kenneth B. McIntosh, Rte. #1, Box 479, Rockvale, Tenn. 37153; James O. Pratt, Murfreesboro, Tenn.; Donald E. Stout, Annandale, Va.

[73] Assignee: Kenneth B. McIntosh, Rockvale, Tenn.

[ * ] Notice: The portion of the term of this patent subsequent to Jul. 21, 2004 has been disclaimed.

[21] Appl. No.: 338,104

[22] Filed: Apr. 14, 1989

Related U.S. Application Data

[63] Continuation of Ser. No. 45,047, May 1, 1987, Pat. No. 4,831,562, which is a continuation of Ser. No. 702,746, Feb. 19, 1985, Pat. No. 4,682,299.

[51] Int. Cl.[5] ..... G08B 1/00; G06G 15/20

[52] U.S. Cl. ..... 364/569; 340/309.15; 340/309.4; 364/413.02

[58] Field of Search ..... 364/569, 413.02, 413.03; 340/309.15, 309.4; 128/680, 687, 690, 736; 221/28

[56] References Cited

U.S. PATENT DOCUMENTS

| | | | |
|---|---|---|---|
| 4,121,574 | 10/1978 | Lester | 128/736 X |
| 4,216,462 | 8/1980 | McGrath et al. | 364/415 |
| 4,223,801 | 9/1980 | Carlson | 221/3 |
| 4,258,354 | 3/1981 | Carmon | 340/309.4 |
| 4,270,547 | 6/1981 | Sterffen et al. | 128/706 X |
| 4,275,384 | 6/1981 | Hicks et al. | 340/309.4 |
| 4,293,845 | 10/1981 | Villa-Real | 340/309.15 X |
| 4,302,752 | 11/1981 | Weitzler | 340/309.4 X |
| 4,360,125 | 11/1982 | Martindale et al. | 364/569 X |
| 4,382,688 | 5/1983 | Mechamer | 221/2 X |
| 4,419,016 | 12/1983 | Zoltan | 368/10 |
| 4,473,884 | 9/1984 | Behl | 364/479 |
| 4,483,626 | 11/1984 | Noble | 368/10 |
| 4,490,711 | 12/1984 | Johnston | 340/309.4 |
| 4,504,153 | 3/1985 | Schollmeyer et al. | 364/569 X |
| 4,573,606 | 3/1986 | Lewis et al. | 221/2 |
| 4,616,316 | 10/1986 | Hampeter et al. | 364/413 |
| 4,682,299 | 7/1987 | McIntosh et al. | 364/569 |
| 4,695,954 | 9/1987 | Roze et al. | 364/415 X |

FOREIGN PATENT DOCUMENTS 3035869 3/1988 European Pat. Off. .

OTHER PUBLICATIONS

"Improving Medication Compliance", Proceeding of a Symposium, Nov. 1984.
"Drugs and the Elderly", 1978.
"Commercial Appeal", 1987.

*Primary Examiner*—Gary V. Harkcom
*Assistant Examiner*—H. R. Herndon
*Attorney, Agent, or Firm*—Antonelli, Terry, Stout & Kraus

[57] ABSTRACT

A medication clock for producing a record of a patient in complying with a medication schedule. A data base is provided which stores the time and date of each medication that the patient takes including those medications taken in response to an alarm by the clock as well as medications taken by the choice of the patient. The dosage schedule may be programmed by reading of information written by the pharmacist.

15 Claims, 11 Drawing Sheets

FIG. 6.

58

102

| | |
|---|---|
| 1 | MEDICINE IDENTIFICATION, TIME AND DATE OF TAKING EACH DOSAGE |
| 2 | |
| 3 | |
| 4 | |
| n | |
| a | TIME, DATE AND TEMPERATURE READING FOR EACH TEMPERATURE READING |
| b | TIME, DATE AND BLOOD PRESSURE READING FOR EACH BLOOD PRESSURE READING |
| c | TIME, DATE AND PULSE RATE READING FOR EACH PULSE RATE READING |
| OTHER INFORMATION FOR PERFORMANCE OF ALARM ETC. | |

104

MEDICATION CLOCK

This is a continuation application of U.S. Ser. No. 045,047, filed May 1, 1987, now U.S. Pat. No. 4,831,562, which is a Continuation of U.S. Ser. No. 702,746, filed Feb. 19, 1985, now U.S. Pat. No. 4,682,299.

BACKGROUND OF THE INVENTION

1. Field of the Invention

The present invention relates to devices which inform patients of the time that each dosage of medication is to be taken under a programmed schedule to assure compliance with prescribed medication taking schedules.

2. Description of the Prior Art

The self-administration of prescribed medications has been and is a problem throughout the world. It is well known that the patient response to prescription medications would be much greater if patients in fact follow the directions, including dosage schedule, for taking prescription medicines specified by physicians.

Surveys indicate that 3% to 5% of hospital admissions are the result of adverse drug reactions. At least one publication has stated that the misprescription of medications by the aged may be responsible for 30,000 deaths and 1.5 million hospital admissions per year. The cost of hospital admissions caused by the improper taking of medications is conservatively estimated to be at least $1 billion per year and, in fact, may be much higher when lost employment and other indirect costs are considered.

Adverse drug reactions are directly related to the number and frequency of doses of medication which are taken. The inability to take drugs in accordance with prescribed routines may in fact substantially increase adverse drug reactions.

It is a well-known fact that the elderly are especially prone to not carefully following the instructions for the taking of medication. The consequences of not properly following the instructions for taking a medication can be espescially harmful to the elderly because of the likelihood that they are taking multiple prescription medications which can interact adversely if not properly taken and further that the level of general physical infirmity in the elderly reduces their ability to withstand the effects of improperly taking medication.

Systems are known for dispensing medication under the control of a timer. Exemplary of these systems are those described in U.S. Pat. Nos. 4,382,688, 4,293,845, 4,275,384, 4,258,354 and 4,223,801.

U.S. Pat. No. 4,382,688 describes a medicinal dispenser having an electronic timer which is used to remind the patient when it is time to take a medication stored in a container associated with the timer.

U.S. Pat. No. 4,293,845 discloses a timer for controlling the taking of dosages of medication for multiple patients. The system totallizes the number of dosages which have been taken by each patient.

U.S. Pat. No. 4,275,384 discloses a portable medicine cabinet with a timer for informing the patient when it is time to take any one of a plurality of medications which are stored within the cabinet. This system includes individual indicators in proximity to compartments provided within the cabinet for storing medications to indicate that it is time to take that particular medication.

U.S. Pat. No. 4,258,354 discloses a portable alarm device for indicating that it is time for a patient to take medications stored within a plurality of compartments provided within the portable alarm device. The times for taking the individual medications may be programmed by a film strip which is perforated at the hours that each of a plurality of medications are desired to be taken by the patient.

U.S. Pat. No. 4,223,801 discloses an automatic periodic pharmaceutical preparation dispenser for alerting patients when particular medications are to be taken.

SUMMARY OF THE INVENTION

The present invention provides an improved medication clock which has advantages over the prior art systems. In accordance with the invention, the times for taking individual dosages are easily programmable by even persons having physical infirmities which prevent or interfere with the programming of the prior art systems. A memory provided in conjunction with the programmable timer records the time and date for the taking of each of the medications being dispensed under the control of the timer. The storage in memory of when the patient takes each dosage of the medication provides an attending physician or other personnel with the ability to analyze the patient's schedule of taking various prescribed medications and the number of dosages taken which can be invaluable for diagnostic or other purposes in analyzing a patient's response to medications. By the use of a printer or other suitable output device, a permanent record can be obtained of the patient's time of taking each dosage of the medications from the memory to provide information in a form which is readily storable in a patient's medical records by the attending physician. Further in accordance with the invention, for those patients who are particularly infirm, a memory is provided for storing the identity, number of dosages and time intervals between dosages for commonly prescribed medications which is utilized to automatically program the time intervals for taking these commonly prescribed medications in response to the patient's causing a coded message to be read. This method of programming eliminates the requirement for manipulating many input controls and in conjunction with the other memory storage capability of storing the identity and time of taking particular medications permits an accurate monitoring system for the taking of medications under prescription which is not intimidating to patients who are either too infirm or otherwise too uncomfortable with inputting a program for taking individual prescription medications.

A medication clock in accordance with the invention includes a plurality of compartments with each compartment being separately used for holding one or more medications to be dispensed, the medications being chosen from prescription medications which have individual dosages to be taken at specific times, prescription medications to be taken under the control of the patient on an as needed basis and non-prescription medications to be taken under the control of the patient; a programmable timer for producing a medication dispensing signal indicating the times during the day that a patient is to take one or more medications; an alarm responsive to the medication dispensing signal produced by the programmable timer for alerting the patient that it is time to take a particular medication, the alarm including a tone generator and a separate visual display indicator located in proximity to each of the compartments, the tone generator producing an audible tone in response to the medication dispensing signal and the visual display indicator in proximity to the compartment associated with the medication to be taken producing a visual indication in response to the medication dispensing signal; a patient acknowledgment switch located in proximity to each of the compartments which each are separately activable by a patient to produce a patient acknowledgment signal that a medication(s) stored in the compartment in proximity to the patient acknowledgment switch has been taken; a memory coupled to the programmable timer and to each patient acknowledgment switch for storing the time and date of each patient acknowledgment signal as an identification of the medication taken, and the time and date of taking each dosage by the patient; and an output coupled to the memory for providing a record of the identification of the medication taken and the time and date of each dosage of the medication taken by the patient for each of the medications being taken by the patient including the medications under the control of the programmable timer.

The invention further includes, a scanning device which is coupled to the programmable timer for reading information for controlling the programming of the identification of the medication to be taken, the time that each dosage is to be taken and the number of dosages and a programmed microprocessor responsive to the information read by the scanning device for causing the programmable timer to be programmed to signal the time for taking each dosage of the medication which is being taken under the control of the programmable timer which has been programmed under the control of information read by the scanning device.

Preferably, the information read by the scanning device is the beginning address of a block of memory in a read only memory (ROM) which stores the identity of the medication to be taken, the number of dosages to be taken and the time between dosages of the medication. A preprogrammed ROM is provided containing a plurality of storage blocks which each have separate beginning addresses which are individually addressable by the read memory address, each storage block storing the identification of a distinct medication to be taken, the time between dosages and the number of dosages to be taken. The programmable timer is programmed for signaling the time for taking of any medication whose identity is stored at one of the memory blocks in conjunction with the time between dosages and the number of dosages stored at that one memory block whose beginning memory address was read by the scanning device. Each storage block for a medication may also include an identification of other medications which are incompatible with that medication. A routine comparison with the other medications which have dosage schedules which have been previously programmed can be used to reveal incompatibilities. Preferably, the actual time for taking individual dosages is determined by computing the times for taking each dosage of the medication based upon the desired time for taking the first dosage and the number of dosages and the time between dosages read from the preprogrammed ROM. The invention further includes a speech synthesizer for producing a synthesized voice message that informs the patient of the identity of the medication to be taken and instructions for taking the medication in response to a medication dispensing signal for indicating that it is time to take any medication having dosage times which have been programmed in accordance with the information contained at a memory block. Each storage block has stored therein information for creating a voice synthesized message to be produced by the speech synthesizer in response to a medication dispensing signal of the medication to be taken and the instructions for taking the medication.

The speech synthesizer may also be used to announce to the patient that it is time for the patient to take a medication located in a particular compartment in response to the medication dispensing signal.

Further in accordance with the invention, a video message generator may be provided which is activated in response to the medication dispensing signal to generate a video display on the patient's television set or other video display.

Further in accordance with the invention, a record forming device, such as a printer, may be coupled to the output for providing a record of the time and date of each dosage of each medication taken or not taken by a patient.

The invention may also be used to monitor other vital signs of the patient, such as blood pressure, pulse rate and temperature. Preferably, a blood pressure measuring device, a pulse rate measuring device and a temperature measuring device is coupled to the memory for storing the time, date and value of each of the aforementioned vital signs as they are read by the patient.

BRIEF DESCRIPTION OF THE DRAWINGS

FIGS. 6 illustrates a memory map of the RAM memory of FIG. 3 which is used for storing the time and date of taking each dosage of each of the medications being taken by the patient under the control of the timer and the information stored in each one of the addressable storage locations associated with a particular medication being taken.

DESCRIPTION OF THE PREFERRED EMBODIMENTS

The present invention provides an improved medication clock which is easily programmable to signal the times for taking each dosage of a plurality of medications from a plurality of compartments and creates a data base for subsequent review by an attending physician or other personnel of the patient's history of taking each of the medications. In addition, the programming of the identification of the medicines to be taken, the number of dosages and the time of taking each dosage can be accomplished for commonly prescribed medications by the patient's causing the reading of a code, which is the beginning address of a block of memory locations storing programming information, provided on or in conjunction with the prescription filled by the pharmacist. The coded address is used to fetch the requisite programming information from one of the memory blocks in the preprogrammed ROM to program the clock with a timed alarm for indicating that it is time to take each dosage of the medication.

Figure 1:
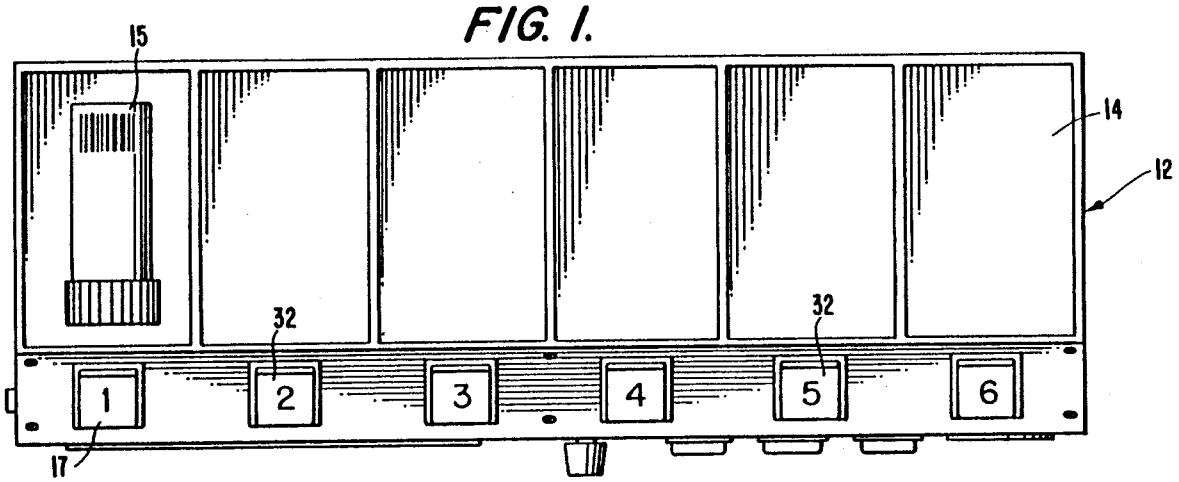
FIG. 1 is a top view of a medication timer in accordance with the invention.
Figure 2:
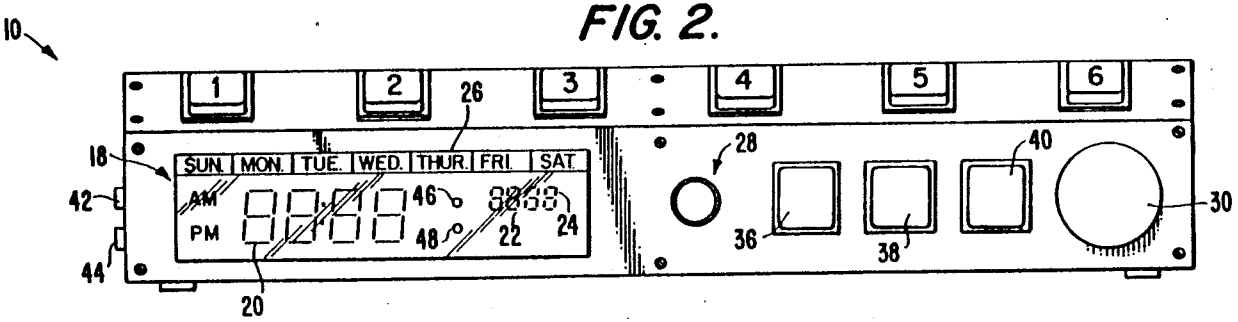
FIG. 2 is a front view of a medication timer in accordance with the invention.
Figure 3:
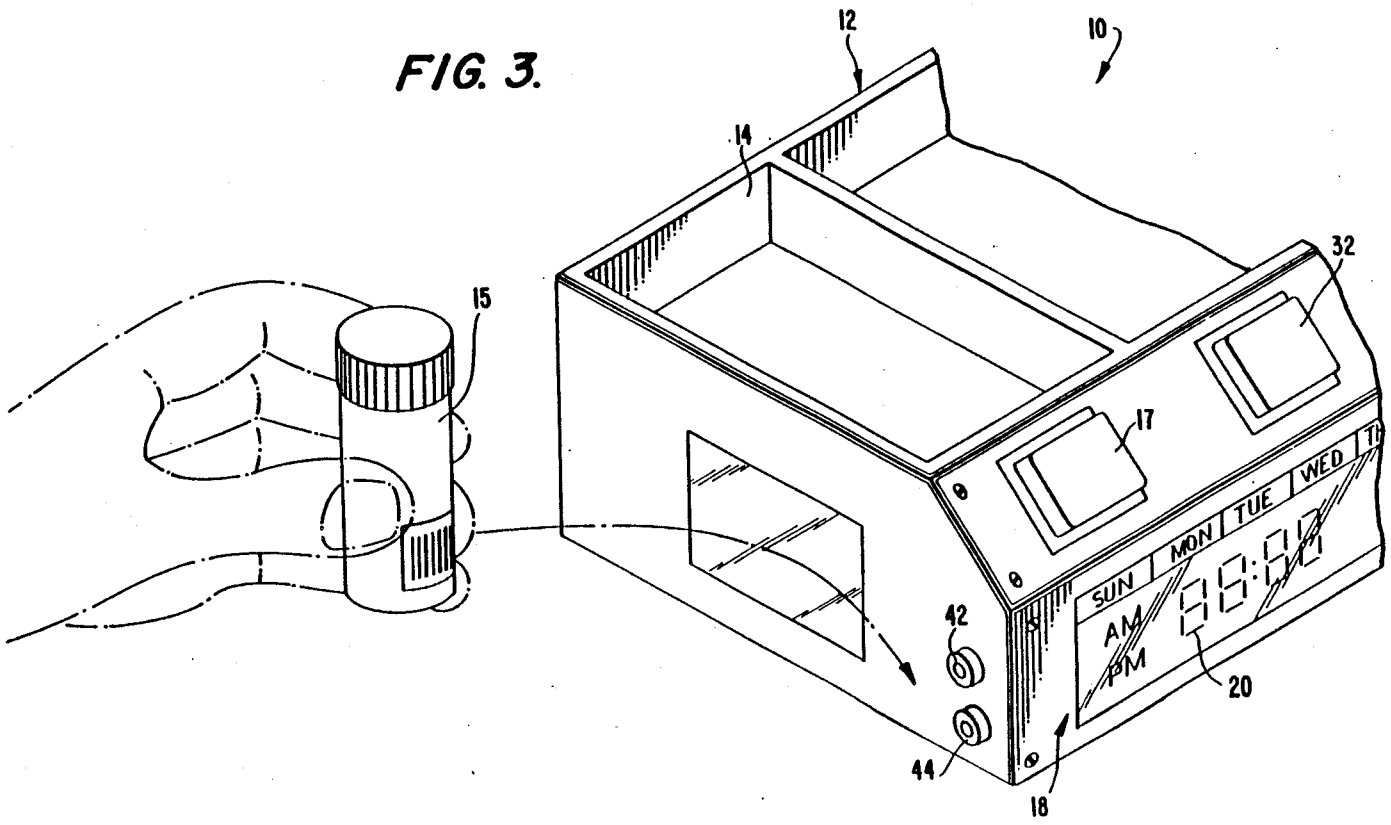
FIG. 3 is a side view of a medication timer in accordance with the invention.

FIGS. 1–3, respectively, illustrate top, front and side views of a medication clock 10 in accordance with the present invention. A housing 12 contains a plurality of compartments 14 each for the storage of one or more medications 15 which are dispensed at least in part under the control of a timer described in detail, supra. The compartments are illustrated as open bins, but may be closable by appropriate closing devices. A number 17, which is associated with each compartment 14, is used to identify the medication in the data base which is described in detail, infra. One or more of the compartments 14 may be used to store nonprescription medications or prescription medications to be taken on an as needed basis. For example, the compartment 14 associated with the compartment identifying number "6" may store prescription medications to be taken as needed. The front face of the housing contains a clock 18 which provides an output of the time 20, the month 22, the date 24, and the day of the week 26. Any conventional microprocessor based clock which performs the aforementioned functions may be used with the present invention. A multiposition switch 28, which preferably has twelve positions, is used by the patient to activate the various functional modes of the present invention. The individual modes of operation which may be selected by the patient are described in detail in conjunction with the flowchart in FIGS. 7–12 of the microprocessor control program used for the present invention. An alarm controlled by the microprocessor based clock 18 is provided for notifying the patient that it is time to take a particular medication or medications contained within one of the six compartments 14. The alarm preferably includes an audio tone generator which causes an audible tone to be emitted by speaker 30 and a visual indicator 32 in the form of a pulsating light which is in proximity to the compartment 14 within which the medication to be taken is stored at the time that the alarm is activated. Nonprescription medications or prescription medications to be taken on an as needed basis, which are stored in one or more of the compartments 14, are taken under the patient's own actions without activation of the alarm. Each visual indicator 32 preferably is a light which pulsates when the alarm signals that it is time to take a particular medication or medications. A patient acknowledgment indicator 34 (FIG. 4) in the form of a patient activated switch is associated with each visual indicator 32. For medications which are taken in response to the alarm function, the patient acknowledgment indicator 34 is activated by the patient's touching of the pulsating visual indicator 32 to cause it to go off and the audio tone generator to cease operating. For medications taken without the alarm, the patient acknowledgment indicator 34 is activated when the patient decides to take the medications. The patient acknowledgment indicator 34 produces a patient acknowledgment signal which performs the function described in detail, infra, of causing the entry of the identification of the medication taken in terms of the number of the storage compartment 14 containing it, and the time and date that the medication was taken for the purpose of updating the patient's medication dosage history. When the multiposition switch 28 is in the appropriate position, the closing of a medication check switch 36 by the patient causes the display of the next programmed time that medication is to be taken in conjunction with an identification of the respective medication compartment in which the medication to be taken is located by the activation of the associated visual indicator 32. The display of the subsequent times for taking each medication are produced by each subsequent closure of the medication check switch 36. A switch 38 is activated by the patient to set either the hours or the month of the clock 18 depending upon the position of the multiposition mode switch 28 as described, infra, in the discussion of the microprocessor control program. A switch 40 is activated by the patient to set either the date 24 or the minutes of the clock 18 depending upon the position of the multiposition mode switch 28 as described, infra, in conjunction with the microprocessor control program. An entry switch 42 is located on the side of the housing 12 for entering the various inputs which have been set in the switches described, supra. A low battery test switch 44 is also located on the side of housing 12 which is activated by the patient to determine if the batteries have discharged to a point where they should be replaced. Low battery indicator 46 is activated when the battery has discharged to a point requiring replacement. Program indicator 48 signals that the programming of the alarm functions has been completed when the multiposition mode switch 28 has been switched to position 0 as described, infra, in conjunction with the flowchart. A code reader 50 (FIG. 3) is located on the side of housing 12 which is provided for reading an encoded beginning memory address of a block of memory used for storing information used for programming the alarm function which is encoded on or in conjunction with a prescription which is to be dispensed under the control of the present invention. Preferably, the code reader is a commercially available unit such as the Intermoc Model 9300, Part 039253, for reading the universal bar code used in conjunction with the identification of numerous products for purposes of merchandising. An output (not illustrated) is also provided on the side of the housing 12 for permitting the connection of a record forming device such as a printer to the data base contained within the RAM described, infra, for the purpose of forming a permanent patient history of the time and date of taking of each dosage of the prescribed medications, including as needed medications and nonprescription medications. Preferably, the output may be an RS232 interface to permit the connection of a printer to the RAM for generating the permanent patient history. It should be understood that the various switches and other functions contained in the housing 12 may be relocated without departing from the present invention.

Figure 4:
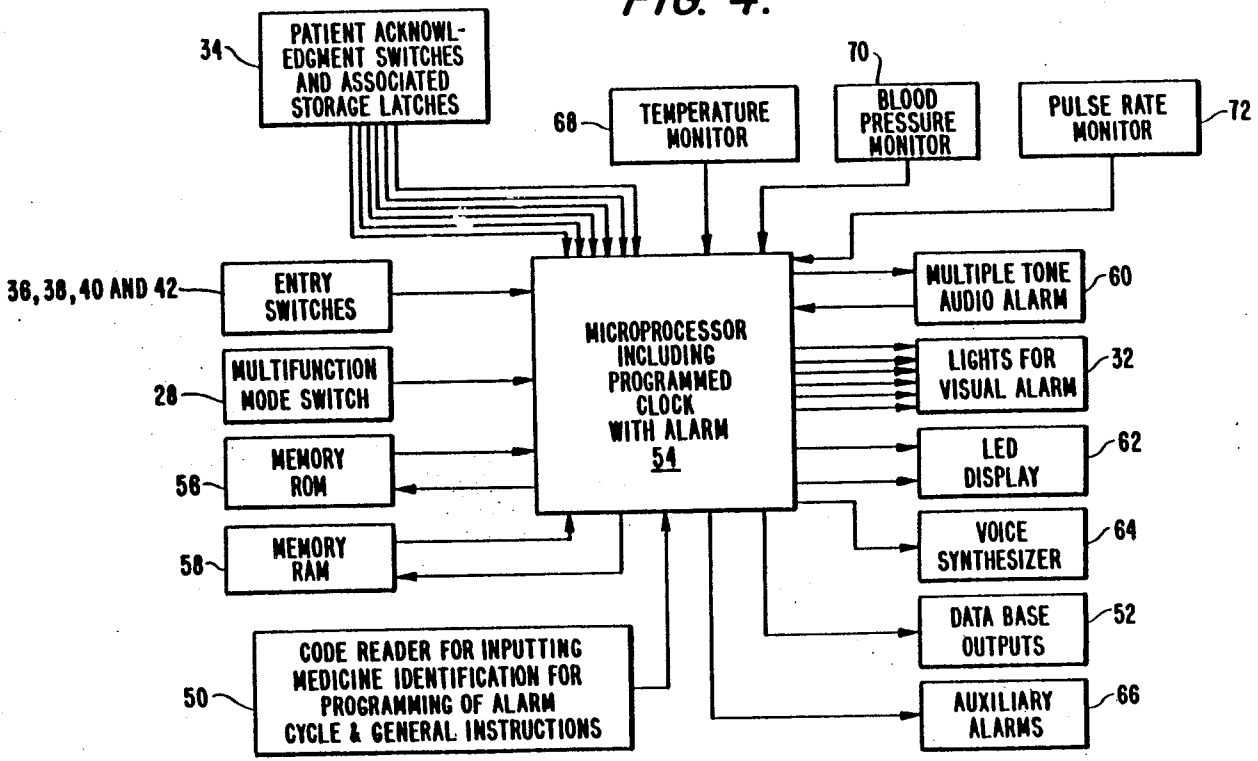
FIG. 4 is an electrical schematic of the present invention.

FIG. 4 illustrates an electrical schematic of the present invention. A programmed microprocessor including a clock with a programmable alarm 54 is used for controlling the programmable functions of the present invention. Any conventional microprocessor may be used in the programming of the control functions of the present invention as described, infra, in conjunction with FIGS. 7–12. The multiposition mode switch 28 is selectively located in any one of 11 positions (position 12 is not used) to activate the different functional modes of the operation and programming of the present invention. The details of the usage of particular switch positions to operate different modes of the invention are described in detail, infra, in conjunction with the flowchart of FIGS. 7–12. Entry input switch 42 is depressed by the patient to enter data for programming purposes for the various modes described, infra, in conjunction with the flowchart. A ROM 56 is connected to the microprocessor 54 for providing preprogrammed information for programming the dosage, times and number of dosages of commonly prescribed medications, the operating system of the invention, speech synthesis data and the initial time and date information when the clock function is first activated. The details of the ROM 56 are described, infra, in conjunction with FIGS. 5(*a*) and 5(*b*). A RAM 58 is connected to the microprocessor 54 for storing the data base of the patient history of taking medications being dispensed under the control of the invention. In addition, the RAM 58 stores other necessary variable data used for the programming of the times for activating and operation of the alarm function of the present invention. Preferably, a total of six patient acknowledgment switches 34 (one for each compartment 14) are provided for signalling the microprocessor 54 that a particular one of the medications being taken under the programmed timing cycle of the present invention or under the patient's own volition (nonprescription or prescription as needed medications) has been taken by the patient. Associated with each patient acknowledgment switch 34 is a latch, such as a flip flop, which stores the patient acknowledgement signal until reset by the microprocessor 54. The latches perform the function of storing all patient acknowledgment signals, including those generated in response to the signaling of an alarm and those which are generated by the patient, when prescriptions are taken on a as needed basis and nonprescription medications which are stored in the compartments 14 are also taken. As has been described, supra, the individual switches 34 are located in proximity to the compartment 14 which contains the medication being taken, and are activated to cause the entry into the data base stored in the RAM 58 of the identification of the medication and the time and date at which the medication was taken for purposes of providing a permanent data record of the patient's history of taking the prescribed medications. The code reader 50 is connected to the microprocessor 54 to provide an input of the beginning address of a block of memory in the ROM 56 at which the identification, number of dosages, and the time between which each dosage is to be taken for commonly prescribed medications and speech synthesis information used for synthesizing a speech message, including medication identification and dosage instruction, are found. Preferably, the code reader 50 is designed to read the universal bar code. The activation of the code reader 50 is under the control of the multiposition mode switch 28 and is described, infra, in conjunction with the flowchart. A multiple tone audio alarm 60 is activated by a medication dispensing signal which is generated when the programmed time for signaling the dispensing of medicine agrees with the actual time of the clock 20. The multiple tone audio alarm contains the speaker 30 described, supra. Preferably, the multiple tone audio alarm generates a tone which cylces smoothly between low and high frequency to produce an easily heard audio alarm for even those patients who have difficulties in hearing. The details of the circuitry for producing the tone which smoothly cycles between low and high frequency do not per se, form part of the present invention and are in accordance with well known oscillator circuitry. For medications taken under the control of the programmed dosage times, the microprocessor 54 also activates one of the visual indicators 32 which identifies the compartment 14 within which the particular medication or medications which are to be taken are located. The individual indicators 32 are pulsated to make them easily visible to the patient. The pulsation of the lights is driven by a relaxation oscillator or other type of oscillator which is keyed into operation by the aforementioned medication dispensing signal generated when the actual time is in agreement with the programmed time for taking a particular medication or medications. The microprocessor 54 drives an LED display 62 for indicating the time 20, month 22 and date 24 as described in conjunction with FIG. 1, supra. In addition, the day 26 is activated by a single light which is not illustrated. A voice synthesizer 64 is activated by the generation of the aforementioned medication dispensing signal to provide a suitable voice synthesized message to the patient. In the mode of operation where the patient manually programs each of the times when the medications are to be taken, the voice synthesized message is preferably a vocal statement to the effect that "it is time to take the medication in compartment number_". When the dispensing times are programmed in accordance with the mode of operation using the code reader 50 to cause the programming of the identification, number of dosages and time for taking the dosages with information from the ROM 56, the voice synthesizer 64 is used to state that it is time to take medication and further state the general instructions for taking the medication including identification of conditions for taking the medication with regard to mealtimes, etc. and further the location of the medication if it must be obtained from a location other than the compartments 14 such as a refrigerator. Data base outputs 52 are coupled to the RAM 58 through the microprocessor 54 to permit the reading of the patient's accumulated dosage history of taking prescribed medications, including medications on an as needed basis and nonprescription medications. The data base outputs may be in many different forms and include the aforementioned RS232 interface for a printer. The details of the particular outputs are not part of the invention per se and may take any well known form. Additionally, one or more auxiliary alarms 66, which are activated by the aforementioned medication dispensing signal, may be provided for further signalling the patient that it is time to take medication. The auxiliary alarms are particularly useful when the patient is hard of hearing, is not in visual contact with the indicators 32 or is located in a remote location. Without limitation, the auxiliary alarms may be a message generator for producing a message to be displayed on the bottom of the patient's television screen that it is time to take medication, an audio message to be generated on the patient's radio or stereo system, an audio message to be produced by a paging system or a transmitter for producing a signal to activate a remote alarm. Circuitry for implementing each of these auxiliary alarms is known or within the skill in the art and, per se, does not form part of the present invention. A temperature monitor 68 is coupled to the microprocessor 54 for providing temperature data, including the temperature reading and time and date of taking the temperature reading for storage in the RAM 58. A blood pressure monitor 70 is coupled to the microprocessor 54 for providing blood pressure data, including the blood pressure reading and time and date of taking of the blood pressure reading for storage in the RAM 58. A pulse rate monitor 72 is coupled to the microprocessor 54 for providing pulse data, including the pulse rate and time and date of taking of each pulse rate reading for storage in the RAM 58. The sensed temperature, blood pressure and pulse rate may be referred to as body parameters.

Figure 5A:
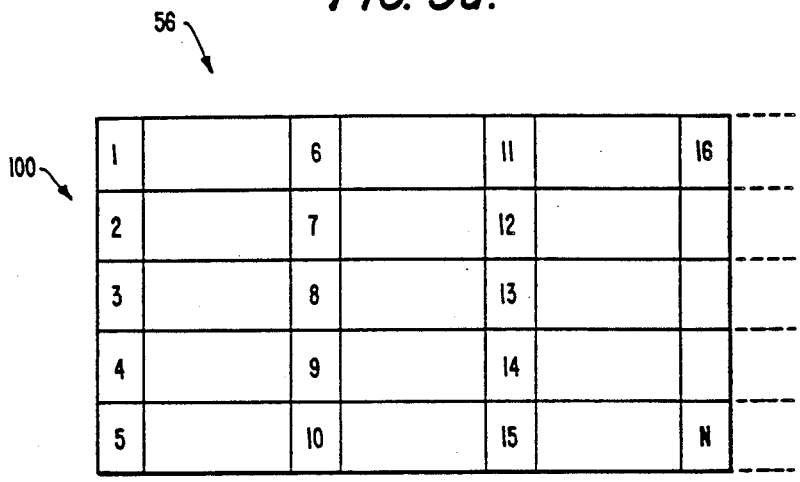
FIGS. 5(*a*) and 5(*b*) respectively illustrate a memory map of the ROM of FIG. 4 and the information stored in a single addressable storage block of the ROM.
Figure 5B:
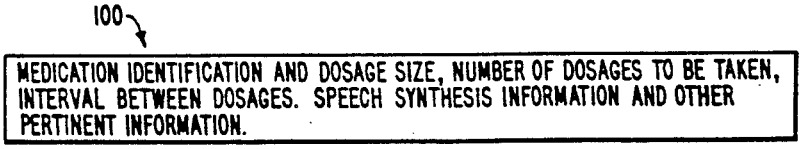
Figure 7:
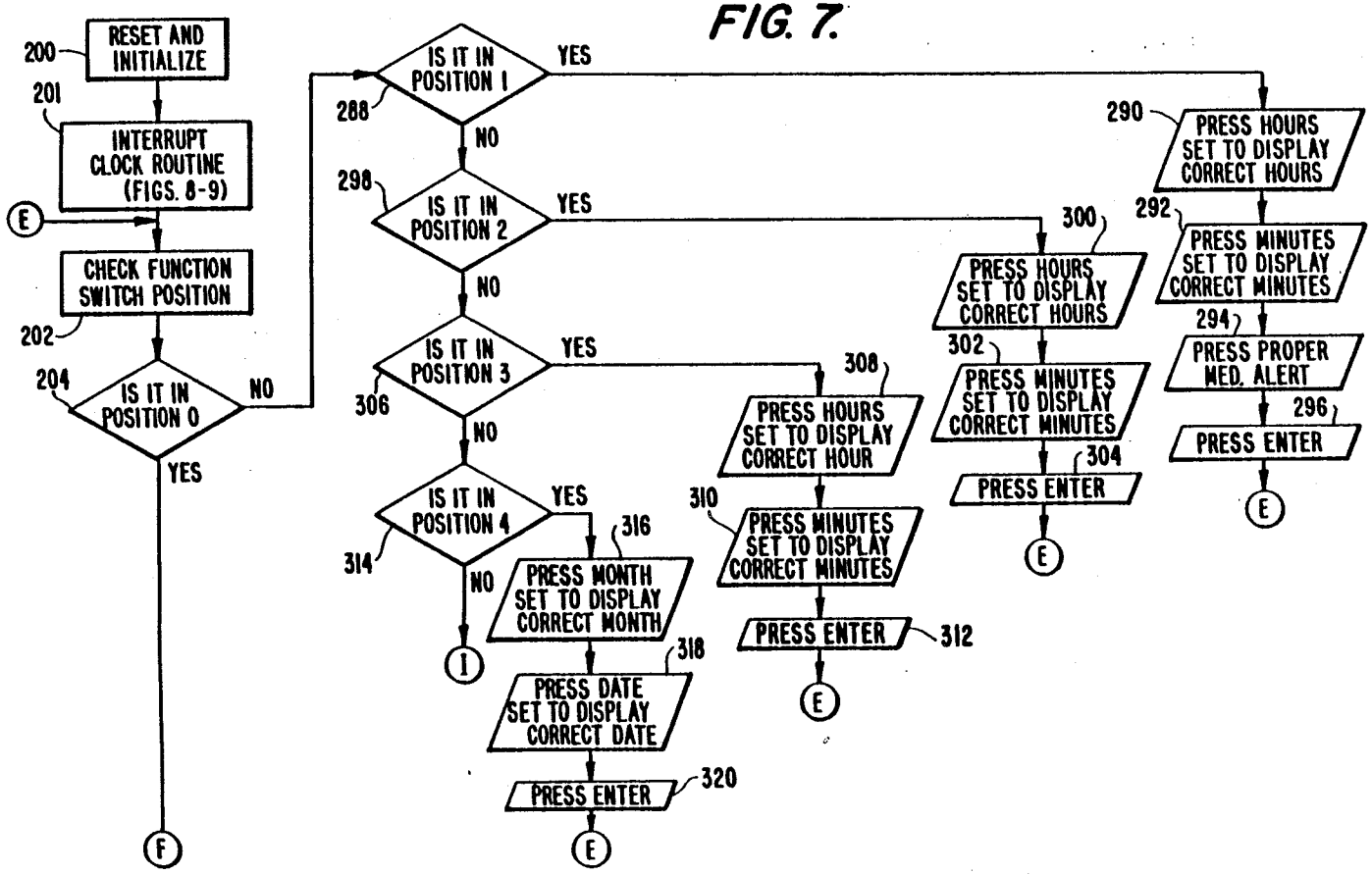
FIGS. 7–12 illustrate a flowchart of the preferred form of microprocessor control program used with the present invention.
Figure 8:
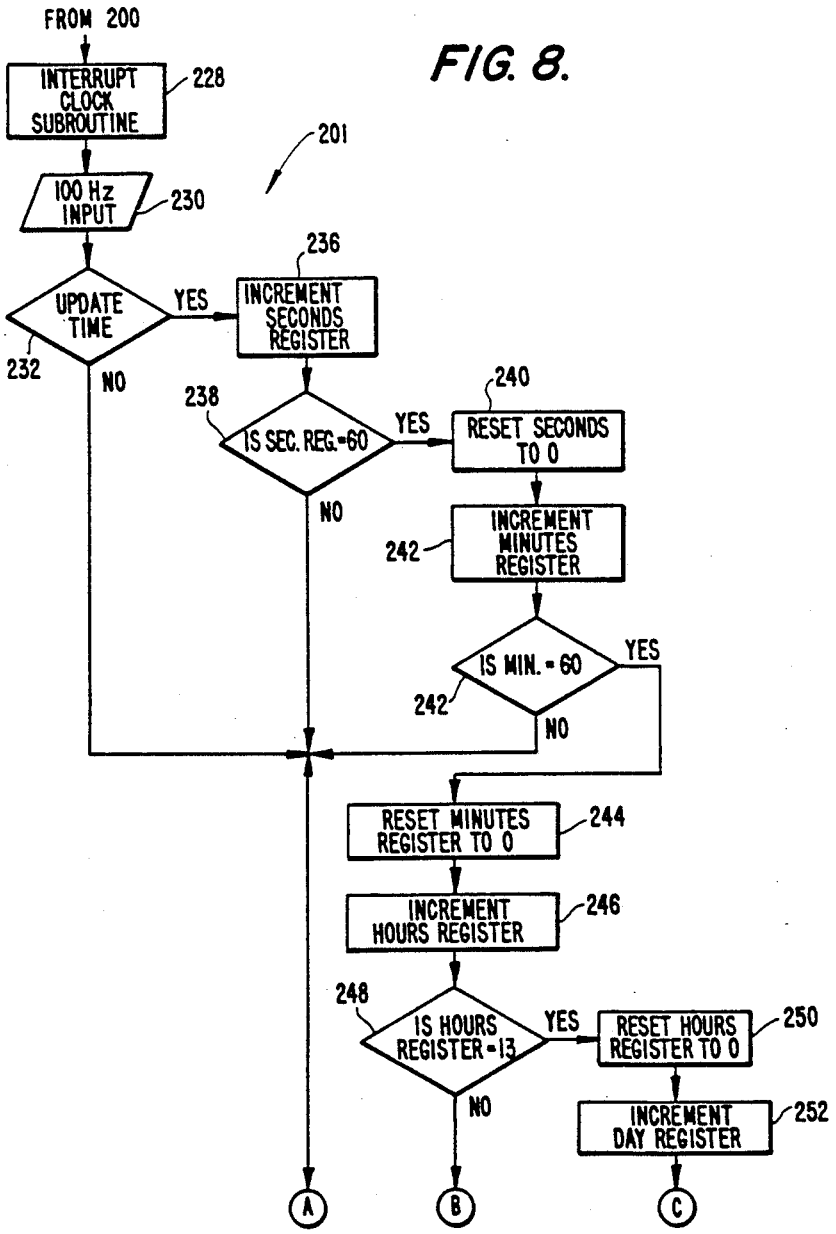
Figure 9:
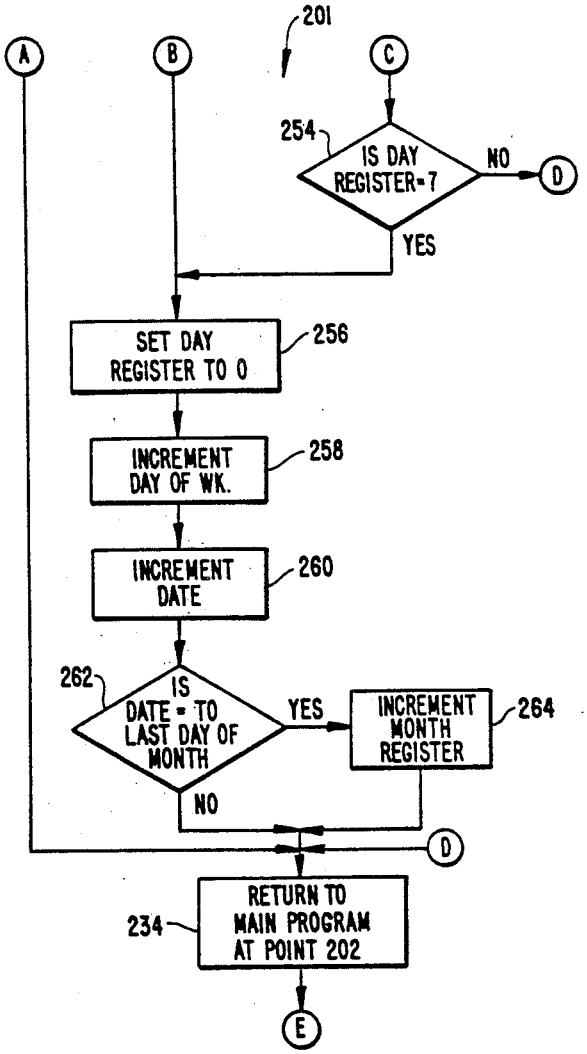
Figure 10:
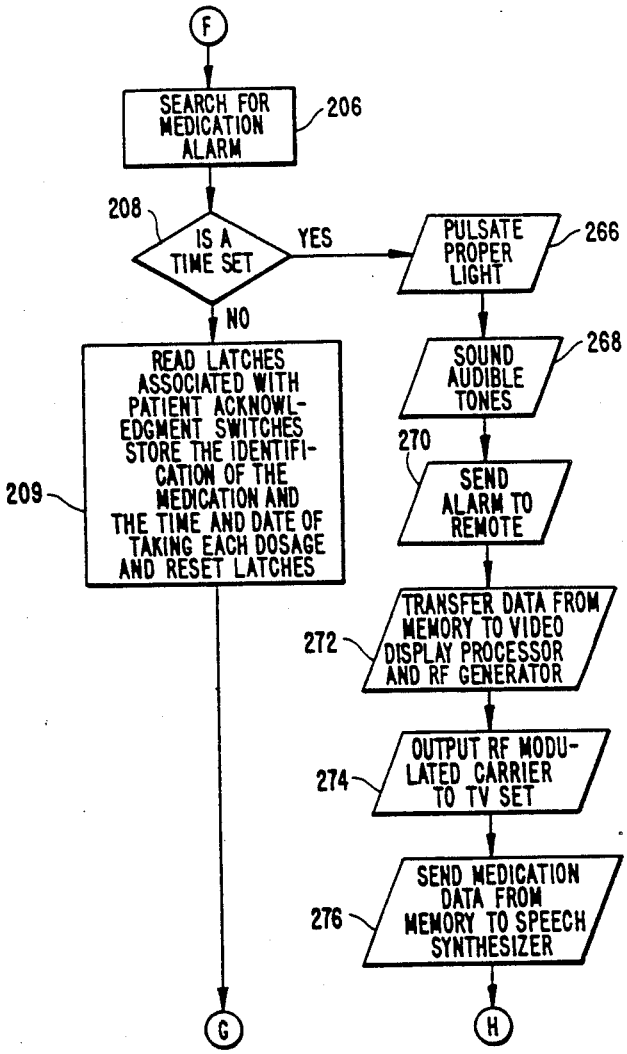
Figure 11:
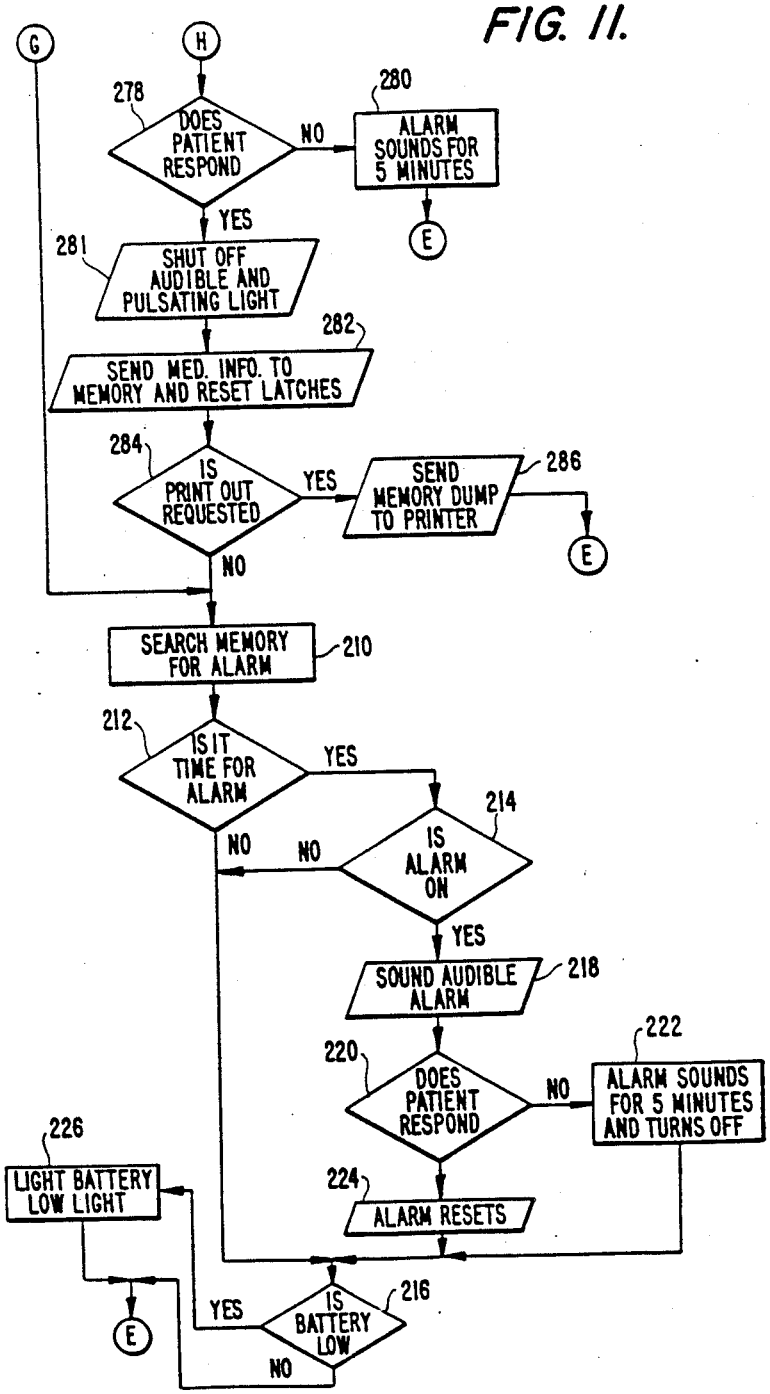
Figure 12:
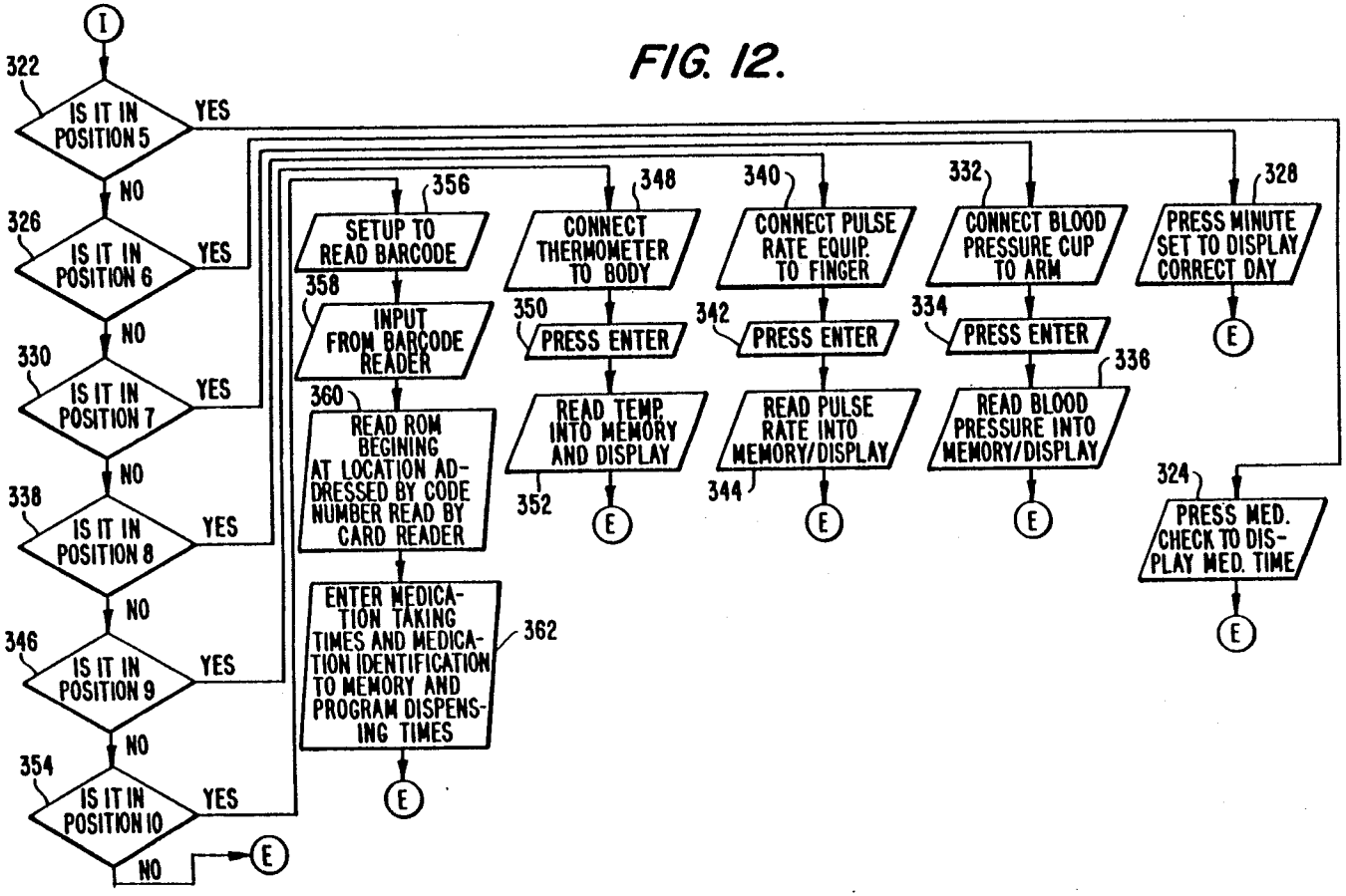

FIGS. 5(*a*) and 5(*b*) illustrate the details of the blocks of information 100 stored in ROM 56 used for programming the times that each dosage of a medication is to be taken, etc. The portion of the ROM 56 used for the general operating system and specifying initial conditions of the clock 18, etc. is not illustrated. FIG. 5(*a*) illustrates a memory map of the individual blocks of programming information 100 of ROM 56. The ROM 56 contains a plurality of addressable storage blocks 100 of information 1—N which each have a distinct beginning address which is addressed by the address code detected by the code reader 50. Each storage block 100 has a sufficient number of individual bits to permit the storage of the information described in conjunction with FIG. 5(*b*). FIG. 5(*b*) illustrates the information which is typically stored in each of the individual storage blocks 100. Contained in each storage block 100 is the identification of the medication which is typically one of the commonly available prescription medications to be taken which has individual dosages automatically programmed by the present invention by the reading of the address by code reader 50. The information used for forming a speech synthesized message which is produced by voice synthesizer 64, the number of dosages to be taken and the time interval between dosages is also stored at each block 100. Programming of the times for the activation of the alarm to signal the taking of any of the medicines which have information stored in the addressable storage locations 1—N of FIG. 5(*a*) is accomplished under the control of the microprocessor in response to the reading of the beginning address by the code reader 50 of the particular block 100 associated with the medication to be taken in the manner described, infra. It is within the scope of the invention to store other pertinent data in the preprogrammed storage locations of FIG. 5(*a*).

FIG. 6 illustrates a memory map of the RAM 58. The RAM 58 is used for the storage of the patient's history of the taking of medications including those under the control of the alarm of the present invention. The RAM 58 includes a plurality of memory blocks 102 which are at least equal in number to the number of compartments 14 contained in the housing 12 and in addition, provides storage for the temperature, blood pressure and pulse rate functions 68, 70 and 72, respectively described, supra, with regard to FIG. 4. Each patient acknowledgment indicator 34 is associatd with a particular memory block 102 to compile in that memory block the patient's record of the taking of a particular medication from the compartment associated with the associated patient acknowledgment indicator. Additionally, the RAM 58 includes additional storage locations 104 for storing other information for programming or performing of the alarm functions including the programming of the particular dosage intervals either manually by the patient or under the control of the automatic programming mode described with reference to FIGS. 5(*a*) and 5(*b*), supra.

FIGS. 7–12 illustrate a flowchart of the microprocessor control program utilized by the microprocessor 54 described above with regard to FIG. 4. It should be understood that any commercially available microprocessor may be used for implementing the control program described in conjunction with the flowchart. The program starts at point 200 where reset and initialization occurs. The program proceeds to point 201 where an interruption routine is entered for updating the time of the microprocessor based clock 18. The specific steps of the interruption routine 201 are discussed, infra, with regard to FIGS. 8–9. The interruption routine is run at a basic rate of 100 Hz to update the clock function at a 100 Hz rate. The interruption program proceeds from point 228 to point 230 where a 100 Hz input is received which is the basic rate for updating the clock function. The receipt of each pulse causes the updating of the clock function to occur. The program proceeds to decision point 232 where a determination is made if a command has been received to update the time. If the answer is "no" at decision point 232, the program branches to point 234 where the program returns to the main program at point 202 to be described, infra. If the answer is "yes" at decision point 232, the program branches to point 236 where a determination is made if a command has been entered to increment the seconds register. The program proceeds to decision point 238 where a determination is made if the seconds register is equal to 60. If the answer is "no" at decision point 238, the program branches to point 234 where the program branches back to point 202. If the answer is "yes" at decision point 238, the program proceeds to point 240 where the seconds register is set to zero. The program proceeds to point 242 where the minutes register is incremented by 1. The program proceeds to decision point 242 where a determination is made if the minutes register is equal to 60. If the answer is "no" at decision point 242, the program branches to point 234 where the program returns to the main program at point 202. If the answer is "yes" at decision point 242, the program branches to point 244 where the minutes register is set equal to zero. The program proceeds to point 246 where the hours register is incremented by 1. The program proceeds to decision point 248 where a determination is made if the hours register is equal to 13. If the answer is "no" at decision point 248, the program branches to point 234 where a return is made to the main program at point 202. If the answer is "yes" at decision point 248, the program branches to point 250 where the hours register is set equal to zero. The program proceeds to point 252 where the day register is incremented by 1. The program proceeds to decision point 254 where a determination is made if the day register is equal to 7. If the answer is "no" at decision point 254, the program branches to point 234 where a return is made to the main program at point 202. If the answer is "yes" at decision point 254, the program branches to point 256 where the day register is set equal to zero. The program proceeds to point 258 where the day of the week is incremented by 1. The day register is used for the activation of the display of the day at point 26 of FIG. 2. The program proceeds t point 260 where the date is incremented by 1. The program proceeds to decision point 262 where a determination is made if the date is equal to the last day of the month. If the answer is "yes" at decision point 262, the program branches to point 264 where the month register is incremented. The program proceeds then to point 234 where the program branches back to the main program at point 202. If the answer is "no" at decision point 262, the program branches to point 234 where the program branches back to the main program at point 202.

At the end of each clock function update cycle the program proceeds to block 202 to reenter the main program where the position of the multiposition mode switch 28 of FIG. 3 is read. There are a total of 11 switch positions which are actually read with the twelfth position not being used. The determination that a switch is in a particular position is used to call a subroutine which is described in detail, infra.

The program proceeds to decision point 204 where a determination is made if the multiposition mode switch 28 is in the zero position. The zero position provides a built-in safety feature which prevents tampering with the information which has been programmed into the microprocessor by the program modes described, infra. When the multiposition mode switch 28 is in the zero position, the invention functions as programmed to provide alarms for indicating when one or more medications are to be taken under the program control while automatically entering the identity of the medicine taken, the time that it was taken and the date that it was taken into the RAM 58 in response to the depressing of the patient acknowledgment switch 34. If the answer is "yes" at decision point 204, the program proceeds to point 206 (FIG. 10) where a search is made of the RAM 58 to fetch the programmed alarm times for testing if any of the medications which are to be dispensed under the timed programmed control are to be currently dispensed by the generation of an alarm. The program branches to decision point 208 where a determination is made if in fact any of the fetched alarm times for indicating the dispensing of medicine matches the current time. If the answer is "no" at decision point 208, the program proceeds to point 209 where each of the latches associated with the patient acknowledgment signals is read. If any of the latches has been set, the identification of the medication in the compartment 14 associated with the medication which as been taken and the time and date of taking each dosage is stored in the appropriate block 102 of the RAM 58. The latches are reset after they are read and the data has been stored in the RAM 58. The program proceeds to point 210 (FIG. 11) where a search is made of RAM 58 to determine if the general alarm function of the clock has been set. The general alarm function is the alarm function performed by a conventional clock. The program proceeds to decision point 212 where a determination is made if the time fetched at decision point 210 is equal to the current time. If the answer is "yes" at decision point 212, the program branches to decision point 214 where a determination is made if the alarm 60 is on. If the answer is "no" at decision point 214, the program branches to decision point 216 to be described, infra. If the answer is "yes" at decision point 214, the program branches to decision point 218 where the multiple tone audio alarm 60 is activated. The program proceeds to decision point 220 where a determination is made if the alarm 60 has been shut off. The multiple tone audio alarm includes a switch contained within the multiple tone audio alarm 60 of FIG. 4 which is used to shut off the alarm and provide a signal to the microprocessor signaling that the alarm has been turned off. If the answer is "no" at decision 220, the program proceeds to point 222 where the alarm is activated for a period up to 5 minutes. After the elapsing of 5 minutes, the program will automatically disable the alarm. The program proceeds from point 222 to point 216 which is described, infra. If the answer is "yes" at decision point 220, the program proceeds to point 224 where the alarm 60 is shut off and the time of activating the alarm is erased from memory. The program proceeds from point 224 to point 216. At point 216 a determination is made if the battery (not illustrated) is low. If the answer is "yes" at decision point 216, the program branches to point 226 where the low battery indicator 46 is activated. If the answer is "no" at point 216, the program branches to point 202 (FIG. 7) described, supra, where the program proceeds to decision point 208. If the answer is "yes" at decision point 208 (FIG. 10), the previously described medication dispensing signal is produced and the program branches to point 266 where the visual indicator 32 associated with the compartment 14 which contains the one or more medicines which are to be taken in response to the alarm is activated. The location of the visual indicator 32 in proximity to the compartment 14 which contains the medication to be taken immediately informs the patient of the location of the medication to be taken upon the pulsating of the particular visual indicator. The program proceeds to point 268 where the multiple tone audio alarm 60 is activated. The program proceeds to point 270 where any remote alarm device is activated by the activation of a transmitter to cause its activation. The program proceeds to point 272 where data is transferred from the ROM 56 to a conventional video display processor for the purpose of generating a word message to be displayed at the bottom of the patient's television set by the generation of an appropriately modulated RF carrier which is to be processed by the patient's television set. The program proceeds to point 274 where the RF modulated carrier is outputted to the patient's t.v. set. The program proceeds to point 276 where the appropriate speech synthesis data stored in the ROM 56 is outputted to the voice synthesizer 64 to cause the generation of a synthesized voice message. If the alarm times have been programmed by the patient, a flag is set to cause the fetching of a standard message from the ROM 56 such as "it is now time to take your medicine in compartment number_". If, on the other hand, the times for dispensing medication have been set by programming in accordance with the code read by the code reader 50, the speech synthesis information associated with the medication information stored in one of the blocks 100 which is to be dispensed is fetched and used for generating the synthesized voice message. In order to identify the location in memory at which the speech synthesis data is to be fetched, it is necessary to read the code number with the code reader 50 which identifies the beginning address of the block of programming information 100 in ROM 56. The program proceeds to decision point 278 (FIG. 11) where a determination is made if the patient has responded by the depressing of the patient acknowledgment switch 34 located in proximity to the compartment 14 containing the medication which is to be taken. If the answer is "no" at decision point 278, the program branches to point 280 where the multiple tone audio alarm 60 is activated for a period up to 5 minutes. If the patient acknowledges the taking of the one or more medications stored in the compartment 14 associated with the visual indicator 32 which is pulsating by activating the associated patient acknowledgment switch 34, the multiple tone audio alarm is immediately stopped. The multiple tone audio alarm is automatically shut off at the end of 5 minutes. The program then branches to point 202. If the answer is "yes" at decision point 278, the program branches to point 281 where the pulsating light 32 associated with the compartment 14 which holds the medicine which is to be taken and the multiple tone audio alarm 60 is shut off. The program proceeds to point 282 where the identity of the medication taken, the time of taking the medication and the date of taking the medication is sent to the RAM 58 for storage in the associated storage block 102 as illustrated in FIG. 6. If the medication dispensing times have been programmed manually, the identification of the medicine is by storage of the compartment number (1-6) 17 of the compartment 14 holding the medication. If, on the other hand, the dispensing times have been programmed by the reading of a coded beginning address of the block of programming information 100 by code reader 50, the complete identification of the medicine is stored as stored in the ROM location 100. The program proceeds to decision point 284 where a determination is made if a printout or other memory output from the data base outputs 52 has been requested. If the answer is "yes" at decision point 284, the program branches to point 286 where a printout or other output of one or more of the storage locations 102 is obtained. The program proceeds from point 286 back to point 202 after the completion of the printout. It is within the scope of the invention to permit the person requesting the printout to address one or more of the individual storage locations 102 up to the complete number of storage locations. If the answer is "no" at decision point 284, the program proceeds to point 210 as previously described.

If the answer is "no" at decision point 204, the program branches to point 288 where a determinatin is made if the multiposition mode switch 28 is in the first position. If the answer is "yes" at decision point 288, the program branches to a subroutine at which the times for activating the alarm for each of the medicines to be dispensed from the individual compartments 14 is set. The program proceeds to point 290 where the hour setting switch 38 is depressed to set a display on the hours display of the time indicator 20 of the desired hour of the activation of the alarm function. Each depressing of the switch 38 causes the hour displayed on the time display 20 to be increased. The patient stops the depressing of the hour display switch 38 at the time that the desired hour is displayed on the time display 20. The program proceeds to point 292 where the minutes setting switch 40 is depressed to cause the display of the desired time in minutes a which the alarm function for the dispensing of a particular medicine is to be activated. Each time the switch 40 is depressed, the display of the minutes is increased. The patient stops the depressing of the switch 40 when the desired number of minutes is displayed on the time display 20. The program proceeds to point 294 where the patient depresses the patient acknowledgment switch 34 associated with the compartment 14 which is to store the medicine which is to be dispensed at the time which has been set at blocks 290 and 292. The program proceeds to point 296 where the entry switch 42 is depressed to cause the entering of the desired time for activating the alarm in the RAM memory 58. The program proceeds to point 202 as previously described.

If the answer is "no" at decision point 288, the program proceeds to decision point 298 where a determination is made if the multiposition mode switch 28 is in the second position. If the answer is "yes" at decision point 298, the program branches to a subroutine for setting the time to activate the general purpose alarm function of the timing device contained within the microprocessor 54. The program proceeds to point 300 where the hours setting switch 38 is activated in the manner previously described in conjunction with block 290. The program proceeds to point 302 where the minutes setting switch 40 is activated in the manner previously described in conjunction with block 292. The program proceeds to point 304 where the entry switch 42 is closed to cause the entry of the desired time for activating the general alarm function in the RAM 58. The program proceeds to point 202 as previously described.

If the answer is "no" at decision point 298, the program branches to decision point 306 where a determination is made if the multiposition mode switch 28 is in its third position. If the answer is "yes" at decision point 306, the program branches to a subroutine for setting the correct display time. The program proceeds to point 308 where the hours setting switch 38 is activated in a manner analogous to that previously described in conjunction with points 290 and 300. The program proceeds to point 310 where the minute switch 40 is activated in a manner analogous to that described in conjunction with points 292 and 302. The program proceeds to point 312 where the entry switch 42 is closed to cause the entry of the desired time into the RAM memory 58. The program proceeds to point 202 as previously described.

If the answer is "no" at decision point 306, the program branches to decision point 314 where a determination is made if the multiposition mode switch 28 is in the fourth position. If the answer is "yes" at decision point 314, the program branches to a subroutine for setting the desired month and date. The program proceeds to point 316 where the month setting switch 38 is activated to set the desired month in a manner analogous to the setting of hours described at points 290, 300 and 308. The program proceeds to point 318 where the desired date is set by the depressing of the date setting switch 40 in a manner analogous to the setting of the desired minutes as described at points 292, 302 and 310. The program proceeds to point 320 where the entry switch 42 is closed to cause the storage of the desired month and date in the RAM 58. The program proceeds to point 202 as previously described.

If the answer is "no" at decision point 314, the program branches to decision point 322 where a determination is made if the multiposition mode switch 28 is in the fifth position. If the answer is "yes" at decision point 322, the program branches to a subroutine which permits the display of the next alarm function for indicating that a medication is to be taken which is located in a particular compartment 14. The program proceeds to point 324 where the switch 36 is depressed to cause a display on the time display 20 of the time of the next alarm function indicating that a medication is to be taken. The program proceeds to point 202 as previously described.

If the answer is "no" at decision point 322, the program proceeds to decision point 326 where a determination is made if the multiposition mode switch 28 is in the sixth position. If the answer is "yes" at decision point 326, the program branches to a subroutine for setting the desired day of the day display 26. The program proceeds to point 328 where the switch 40 is depressed to set the desired display of the correct day. Each time the switch 40 is depressed, the day is augmented by 1. When the desired day is displayed on the day display 26, the multiposition mode switch 28 is changed to another position to enter another mode of operation. The program proceeds to point 202 as previously described.

If the answer is "no" at decision point 326, the program proceeds to decision point 330 where a determination is made if the multiposition mode switch is in the seventh position. If the answer is "yes" at decision point 330, the program branches to a subroutine for reading the patient's blood pressure by the activation of the blood pressure monitor 70. The program proceeds to point 332 where the patient connects the blood pressure sensor to permit the taking of a reading. The program proceeds to point 334 where the entry switch 42 is closed to cause entry of the blood pressure reading which has been read into the part "b" of sections 102 the RAM of FIG. 6 as illustrated at point 336. The program proceeds to point 202 as previously described.

If the answer is "no" at decision point 330, the program proceeds to decision point 338 where a determination is made if the multiposition mode switch 28 is in the eighth position. If the answer is "yes" at decision point 338, the program branches to a subroutine for causing the pulse rate of the patient to be monitored. The program proceeds to point 340 where the pulse rate monitor is connected to the patient. The program proceeds to point 342 where the entry switch 42 is closed to cause the storage of the pulse rate which has been read in the part "c" of memory sections 102 of FIG. 6 as illustrated at point 334. The program proceeds point 202 as previously described.

If the answer is "no" at decision point 338, the program proceeds to decision point 346 where a determination is made if the multiposition mode switch 28 is in the ninth position. If the answer is "yes" at decision point 346, the program branches to a subroutine for reading the patient's temperature. The program proceeds to point 348 where the temperature monitor is used by the patient to take a reading of the patient's temperature. The program proceeds to point 350 where switch 42 is closed to cause the storage of the temperature reading in part "a" of memory sections of 102 of FIG. 6 as illustrated at point 352. The program proceeds to point 202 as previously described.

If the answer is "no" at decision point 346, the program proceeds to decision point 354 where a determination is made if the multiposition mode switch 28 is in the tenth position. If the answer is "yes" at decision point 354, the program branches to a subroutine which causes the reading of a coded address contained on or in conjunction with a patient's prescription is as illustrated in FIG. 3 by the code reader 50. As stated, supra, the code is the beginning address of the block of information 100 to be used for programming each dosage time of a particular commonly prescribed medicine. The program proceeds to point 356 where the code reader 50 is initialized to permit the reading of the code. As described above, preferably the code reader is a commercially available reader designed for reading the universal bar code. The program proceeds to point 358 where the address which has been read by the code reader 50 is inputted to the microprocessor to permit the fetching from the ROM 56 of the desired programming information in one of the blocks 100 as described above in conjunction with FIGS. 5(*a*) and 5(*b*). The program proceeds to point 360 where the beginning memory address of the block 100 in the ROM 56 is read which is addressed by the number which has been read by the code reader. The program proceeds to point 362 where the programming information which has been read from the addressed block 100 in the ROM memory 56 is entered into the RAM memory 58 and the desired times for taking that medication are programmed in a manner analogous to the patient activated subroutines described above with regard to the setting of the time for activating the alarm function to indicate that a medication should be taken. Further in accordance with this mode of operation, incompatibility between medications can be checked prior operation. Each location 100 of the ROM 56 can be programmed to store the identification of other medications which should not be taken in conjunction with the particular medication stored at the location. The storage of the identification of incompatible medications can be by the address 100 of FIG. (a) such as "1", "2", etc. Then a comparison step can be made such that the number of the medications which are already programmed to be taken as stored in the ROM can be compared with the medication to be taken in accordance with the stored programming information stored in one of the memory blocks. When an incompatibility is detected by agreement between previously programmed medications and the medication to be taken, an alarm may be activated and the incompatibility can be entered into the RAM data base. If the answer is "no" at decision point 354, the program proceeds to decision point 202 as previously described.

The choice of the medications which are to be included within the ROM memory 56 to implement the programming feature activated by the reading of the beginning memory address of a particular block of programming information 100 by the code reader 50 is a matter of choice which ultimately is only limited by the amount of memory available in ROM 56 which is contained in the implementation of the invention. As a practical matter, approximately the top 100 prescriptions account for approximately 70% of the prescriptions being written. Additionally, there are approximately 600 base medications which are prescribed and approximately 25,000 different brands of prescription medicines. Thus, in accordance with the invention, the number of medications which are stored in the ROM memory can be chosen from the commercially available base medicines. The pharmacist filling the prescription controls the programming of the times for administration of a particular medicine by the encoding of the beginning address of the block of programming information 100 on or in conjunction with prescription at which in the ROM 56 is found the identification of the medication including size of dosage, the times for dispensing dosages or time between dosages, the number of dosages to be taken and the appropriate data for creating a voice synthesized message of instructions for taking the medication. In the preferred form of the invention, the pharmacist will utilize a universal bar code generator for encoding on the side of the prescription container or on the top thereof the beginning memory address of the block of programming information 100 in the ROM 56 at which the data for programming that particular medication are stored. It is only necessary to store medication identifications and times for taking of dosages for generic brans of the medication for the reason that the voice synthesized message does not have to identify the particular brand name or its generic identification. Thus, if the physician writing the prescription requires that it be filled with a brand name, the pharmacist needs to only encode with the universal bar code writer or an equivalent code generator the beginning address in the ROM 56 of the block of programming information 100 where the appropriate generic medication programming data is stored.

When the dispensing of medication is programmed in accordance with the programming information stored at the blocks 100 in the ROM memory 56, the actual times at which medication is to be taken can be set in either of two manners. In the first manner, especially in the case of medications which must be taken around mealtime, the times for taking the medication which are stored in the memory may be set at times at which patients conventionally would be eating if they follow a normal meal schedule. In the alternative, the storage location associated with each medication will store the interval between which dosages of the medication are to be taken. The actual time for taking each dosage of the medication is determined by the first dosage being taken at the time that the code reader 50 reads the beginning address of the block of programming data 100 in the ROM 56 with the subsequent times being determined by the adding of the interval between dosages to the time of the first dosage. In either case, the total number of dosages which is stored in the addressed storage location 100 in the ROM 56 which is associated with the particular medication is monitored by a software counter which is associated with each of the storage locations 102 of the medications 1—N of FIG. 5. The number of dosages which has been taken which is stored in the memory section 102 associated with that medication is compared with the counter value. When the total number of dosages to be taken is equal to the number which has actually been taken, the dosage schedule which is stored in the RAM memory 58 is automatically erased while the dosage history of each medication at location 102 is retained.

At any time during the alarm cycle in either the mode where the patient programs the dosage intervals or where the programming is done in response to the reading of programming from the ROM memory 56, the patient's dosage history may be outputted to form a permanent record by the data base outputs, such as a printer. Additionally, the same outputting capability exists with respect to the temperature, blood pressure and pulse rate storage functions described above.

An alternative embodiment of the invention which uses the code reader 50 to automatically program the times for taking a medication reads the information for programming directly from the coding contained on the prescription container or provided in conjunction with the prescription instead of obtaining it from a ROM. With this embodiment, the coded information as read by the code reader 50 is decoded by the microprocessor 54 and used to automatically program the times for taking the medication in a manner analogous to that described for the manual programming of the times for taking medication as described with reference to points 288–296 of FIG. 7.

While the invention has been described in terms of its preferred embodiment, it is intended that numerous modifications may be made thereto without departing from the spirit and scope of the invention as defined in the appended claims.

We claim:

1. A medication clock comprising:

(a) a plurality of compartments with each compartment being separately usable for holding one or more medications to be taken by a person either in response to an alarm or medications not taken in response to an alarm;

(b) a programmable timing means which produces a medication dispensing signal indicating the time that a person is to take one or more medications to be taken at specific times;

(c) means, responsive to the medication dispensing signal produced by the programmable timing means, to produce an alarm for alerting the person that is time to take a particular medication;

(d) means which are separately activable by the person for producing an acknowledgement signal that any one of the medications stored in one of the compartments has been taken either in response to an alarm or not in response to an alarm;

(e) a memory, coupled to the programmable timing means, for storing an identification of each medication taken and the time and date of taking each dosage of each medication as signalled by the occurrence of an acknowledgement signal by one of the means for producing an acknowledgement signal; and (f) means, coupled to the memory, for providing an output of the identification of the medication, and time and date of each dosage of medication taken by the person which is stored in memory for each of the medications being taken by the person.

2. A medication clock in accordance with claim 1 further comprising:

means, coupled to the means for providing an output, for providing a dosage record of information stored in the memory for each medication being taken including an identification of the medication taken and the time and date of each dosage taken.

3. A medication clock in accordance with claim 2 wherein:

the means for producing a dosage record is a printer.

4. A medication clock in accordance with claim 1 wherein:

(a) each of the means for producing an acknowledgement signal is in proximity to a different one of the compartments and has an associated latch coupled thereto for storing an acknowledgement signal produced thereby; and (b) the programmable timing means cyclically reads each of the latches and when any one of the latches which is read has been set, the programmable timing means causes the storage in one of the storage locations of the memory a time and date of when a medication was taken from a compartment associated with the set latch and an identification of the medication which was taken and thereafter resets the latch.

5. A medication clock in accordance with claim 1 further comprising:

(a) means for reading one or more body parameters; and (b) means, coupled to each of the one or more means for reading body parameters, for causing the one or more parameters to be stored in the memory along with the date and time that each body parameter was read.

6. A system for dispensing one or more medications from storage in at least one of a plurality of compartments chosen from medications which have individual dosages to be taken at specific times, comprising:

(a) programmable timing means which produces a signal indicating the time that a person is to take one or more medications to be taken at specific times including medications to be taken in response to an alarm and medications not to be taken in response to an alarm;

(b) means, responsive to the signal produced by the programmable timing means, for producing an alarm for alerting the person that it is time to take a particular medication;

(c) means, activable by the person associated with each compartment, for producing an acknowledgement signal that any one of the medications has been taken in response either to an alarm or not in response to an alarm, a distinct acknowledgement signal being produced for each of the medications being taken;

(d) a memory, coupled to the programmable timing means for storing the time of occurrence of at least one of the acknowledgement signals and an identification of the medication which was taken; and (e) means, coupled to the memory, for providing an output of the identification of the medication, and time of each dosage of medication taken by the person which is stored in the separate locations of the memory for each of the medications being taken by the person.

7. A medication clock in accordance with claim 6 further comprising:

means, coupled to the means for providing an output, for providing a dosage record of information stored in memory for each medication being taken including an identification of the medication taken and the time and date of each dosage taken.

8. A medication clock in accordance with claim 7 wherein:

the means for producing a dosage record is a printer.

9. A medication clock in accordance with claim 6 wherein:

(a) each of the means associated with each of the compartments for producing an acknowledgement signal has an associated latch coupled thereto for storing an acknowledgement signal produced thereby; and (b) the programmable timing means cyclically reads each of the latches and when any one of the latches which is read has been set, the programmable timing means causes the storage in one of the storage locations of the memory a time and date of when a medication was taken from a compartment associated with the set latch and an identification of the medication which was taken and thereafter resets the latch.

10. A medication clock in accordance with claim 6 further comprising:

(a) means for reading one or more body parameters; and (b) means, coupled to the means for reading body parameters, for causing the one or more parameters to be stored in the memory along with the date and time that each body parameter was read.

11. A system for recording the time of taking a plurality of medications with each medication being taken in individual dosages with dosages being taken either in response to or not in response to an alarm comprising:

(a) a plurality of means activable by a person each for producing a distinct acknowledgement signal that one or more of the plurality of medications has been taken at a particular time either in response to or not in response to an alarm, a time being assigned to when each patient acknowledgement signal is generated;

(b) a memory, coupled to the programmable timing means, for storing the time of the generation of the acknowledgement signal as the time of taking the medication and an identification of the medication which was taken; and (c) means, coupled to the memory, for providing an output of the identification of the medication, and time of each dosage of medication taken by the person which is stored in the separate locations of the memory for each of the medications being taken by the patient.

12. A medication clock in accordance with claim 11 further comprising:

means, coupled to the means for providing an output, for providing a dosage record for each medication being taken including an identification of the medication and the time and date of each dosage taken.

13. A medication clock in accordance with claim 12 wherein:

the means for producing a dosage record is a printer.

14. A medication clock in accordance with claim 11 wherein:

(a) each of the means for producing an acknowledgement signal is in proximity to a different compartment and has an associated latch coupled thereto for storing an acknowledgement signal produced thereby; and (b) the programmable timing means cyclically reads each of the latches and when any one of the latches which is read has been set, the programmable timing means causes the storage in one of the storage locations of the memory a time and data of when a medication was taken from a compartment associated with the set latch and an identification of the medication which was taken and thereafter resets the latch.

15. A medication clock in accordance with claim 11 further comprising:

(a) means for reading one or more body parameters; and (b) means, coupled to the means for reading body parameters, for causing the one or more parameters to be stored in the memory along with the date and time that each body parameter was read.

* * * * *